United States Patent [19]

Wolma

[11] 4,067,152

[45] Jan. 10, 1978

[54] FASCIA COMPRESSION CLIP

[75] Inventor: Rodney J. Wolma, Grand Rapids, Mich.

[73] Assignee: Philip L. Johnson, Grand Rapids, Mich.

[21] Appl. No.: 751,978

[22] Filed: Dec. 17, 1976

[51] Int. Cl.[2] ..... E04D 13/15

[52] U.S. Cl. ..... 52/60; 52/58; 52/96; 52/127

[58] Field of Search ..... 52/105, 96, 95, 94, 52/127, 60, 58

[56] References Cited

U.S. PATENT DOCUMENTS

| | | | |
|---|---|---|---|
| Re. 27,761 | 9/1973 | Attaway | 52/60 |
| 1,642,945 | 9/1927 | Davidson | 52/127 |
| 2,857,861 | 10/1958 | Trostle | 52/94 |
| 3,086,324 | 4/1963 | Cheney | 52/96 |
| 3,100,951 | 8/1963 | Hickman | 52/96 |
| 3,170,268 | 2/1965 | Balzer et al. | 52/278 |
| 3,308,588 | 3/1967 | Von Wedel | 52/127 |
| 3,404,495 | 10/1968 | Simpson, Jr. | 52/58 |
| 3,435,574 | 4/1969 | Hallock | 52/278 |
| 3,571,992 | 3/1971 | Comiskey | 52/94 X |
| 3,624,973 | 12/1971 | Attaway | 52/60 |
| 3,696,575 | 10/1972 | Armstrong | 52/287 |
| 3,719,010 | 3/1973 | Hickman | 52/60 |
| 3,738,068 | 6/1973 | Attaway | 52/94 |
| 3,992,827 | 11/1976 | Johnson | 52/94 X |

FOREIGN PATENT DOCUMENTS

| | | | |
|---|---|---|---|
| 1,385,143 | 11/1964 | France | 52/96 |
| 2,335,223 | 1/1975 | Germany | 52/94 |
| 2,255,950 | 5/1974 | Germany | 52/94 |

*Primary Examiner*—Leslie Braun

*Attorney, Agent, or Firm*—Price, Heneveld, Huizenga & Cooper

[57] ABSTRACT

This specification discloses an extruded fascia including an integral deformable clip for sealably compressing roofing material to a water dam. The clip includes a lever receiving notch facilitating deforming the clip and interlocking hooks to lock the clip in the sealing position.

9 Claims, 2 Drawing Figures

FASCIA COMPRESSION CLIP

BACKGROUND OF THE INVENTION

1. Field of the Invention

The invention relates generally to building structures and, more particularly to the interconnection of a roof deck to a wall or the like extending above the roof at an edge thereof.

2. Prior Art

Roof decks are typically characterized by having a low pitch or a substantially horizontal surface. A raised portion around the perimeter of the roof permits rain water to be controlled without spilling over the edge of the roof. Additionally, such a raised portion can also serve as a barrier for roof covering material such as gravel or the like. The raised portion, such as a wall, can be covered with outwardly facing decorative panels such as fascia, to enhance the appearance of a building. Various means have been suggested for connecting the roofing material to the raised wall to provide a barrier against the penetration of water either through the roof, the wall or the junction of the roof and the wall. Typically, additional independent means have been required for mounting the fascia.

U.S. Pat. No. 3,719,010 issued to J. B. Hickman on Mar. 6, 1973 teaches a relatively complex inverted U-shaped member with a clamping structure facing outwardly from the inner side of the wall of the building for receiving a locking structure which is coupled to the edge of the roofing material. The U-shaped member is screwed to the inner side of the wall. The roofing material extends toward the U-shaped member and is clamped from both sides by flashing strips having flanged end portions. The flashing strips in turn are connected to each other and to the intervening material by means of a screw. The flanged end portions of the flashing strips holding the roofing material are mated with the clamping structure of the U-shaped member. In this system the coupling of the clamping structure and the flashing strips is typically accomplished on the roof when the flanged end portions of the flashing strips are properly aligned to mate with the clamping strips. Accordingly, the relative alignment of the two flashing strips and the roofing material with the clamping structure must be maintained while the screws are inserted through the flanges and the roofing material.

Such an assembly procedure is difficult and time consuming thereby greatly increasing cost of construction. Additionally, the insertion of an exposed screw through the flashing and roofing material provides a natural point for the beginning of a leak. Pressure on the roofing material is not even throughout its connection to the flashing and is greater at the points where the screws are inserted. Such localized pressure zones may provide a focal point for the starting of breaks or cracks in the roofing material or flashing. As a result, water may not only seep through the roofing material around the edges of the screw, but through cracks in the roofing material starting at the screw.

A similar structure where the roofing material is compressed by a flange member and secured by means of screws as taught in U.S. Pat. No. 3,624,973 issued to J. J. Attaway on Dec. 7, 1971. This patent also teaches using screws to secure a fascia component to the wall.

U.S. Pat. No. 3,738,068 issued to J. J. Attaway on June 12, 1973 teaches compressing roofing material between two separate compression flanges. However, instead of driving screws through the compression flanges and the intervening roofing material, a fixed overhanging flange supports a screw driven through the overhanging flange and screwed down onto the compression flange covering the roofing material thereby securing the roofing material between the two compression flanges. During installation, care must be taken to prevent the screws from puncturing through the compression flange and the roofing material. Even when puncturing does not occur, there are localized pressure points which may damage roofing material and promote cracks and leaks. Additionally, there remains the need to individually adjust screws evenly to provide a suitable tight uniform seal. Further, the separate compression flanges and the roofing material must be simultaneously and correctly aligned when the screws were tightened to secure the assembly. This assembly procedure may also be prone to being relatively time consuming and difficult to accomplish thereby increasing cost of construction.

SUMMARY OF THE INVENTION

This invention teaches an assembly for mounting fascia and for connecting roofing material to a wall or a raised portion surrounding the roof deck by providing an easily installed seal around the perimeter of the roof. This seal is installed in a relatively simple and quick operation. The seal has substantially uniform pressure along its length, thus virtually eliminating cracking, and requires no separate fasteners such as screws, thereby eliminating a costly and time consuming installation step which can easily cause leaks. Nevertheless, the invention provides positive locking of the seal. Further, the assembly which locks the seal also positively secures the fascia to the periphery of the roof. Thus two functions are provided by a single, relatively simple installation step. The invention achieves these advantages while providing an uncomplicated mounting structure which can be relatively inexpensively extruded.

Apparatus embodying the present invention includes a fascia clip having a face member with a generally vertical orientation along the exterior of the wall and having a first and second leg extending from an upper portion of the face member over the wall toward the roof. In one embodiment of this invention, engaging means extending between the two legs, such as interlocking hooks, permit one of the legs to be secured in a deformed position for compressive contact with a roofing material. In one embodiment the deformable leg has means such as a slot for receiving a forcing tool to apply a deforming force to the deformable leg.

DETAILED DESCRIPTION OF THE PREFERRED EMBODIMENT

Figure 1:
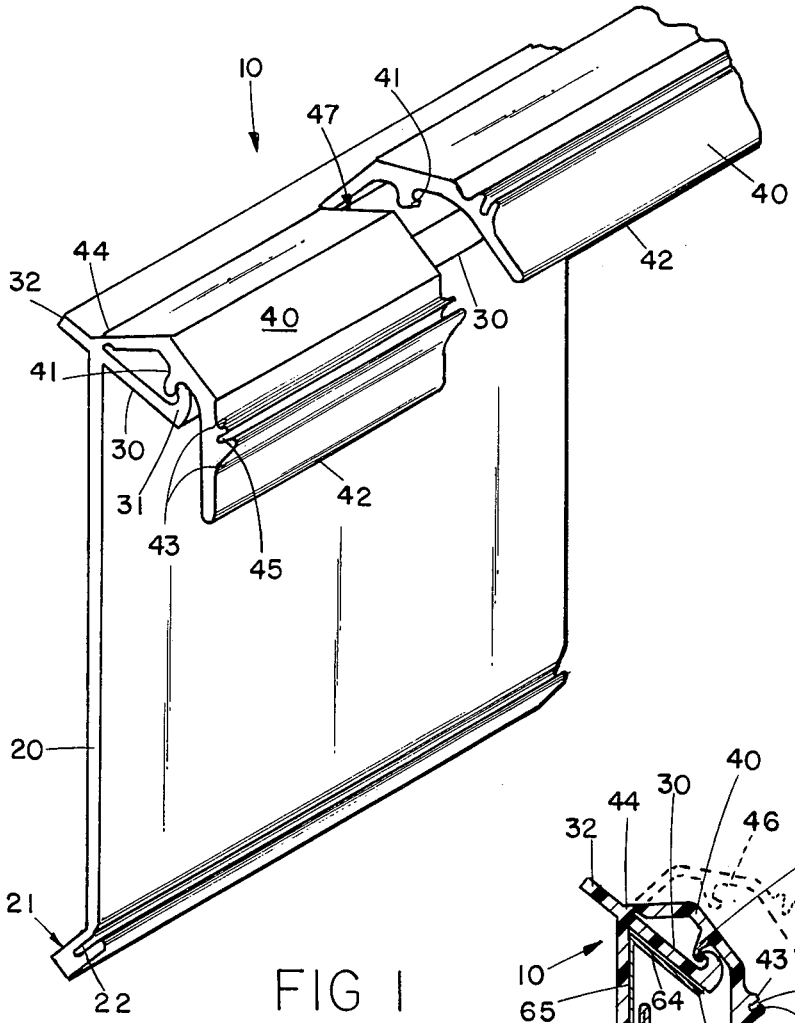
FIG. 1 is a segmented rear perspective view of a fascia compression clip constructed in accordance with an embodiment of this invention and having a first portion in a deformed, locked position and a second portion in an undeformed, unlocked position.

Referring to the FIGS., a one-piece elongated, integral fascia compression clip 10 preferably extruded of aluminum includes a generally vertical, planar front face member 20, which can be secured to the vertical outwardly facing surface 52 of a wall 70 adjacent a roof 53 (FIG. 2), and integral legs 30 and 40. Front face 20 includes a downwardly and outwardly extending bottom flange 21 having a rearwardly and upwardly facing elongated opening 22 for securing the bottom portion of the clip as described below.

Figure 2:
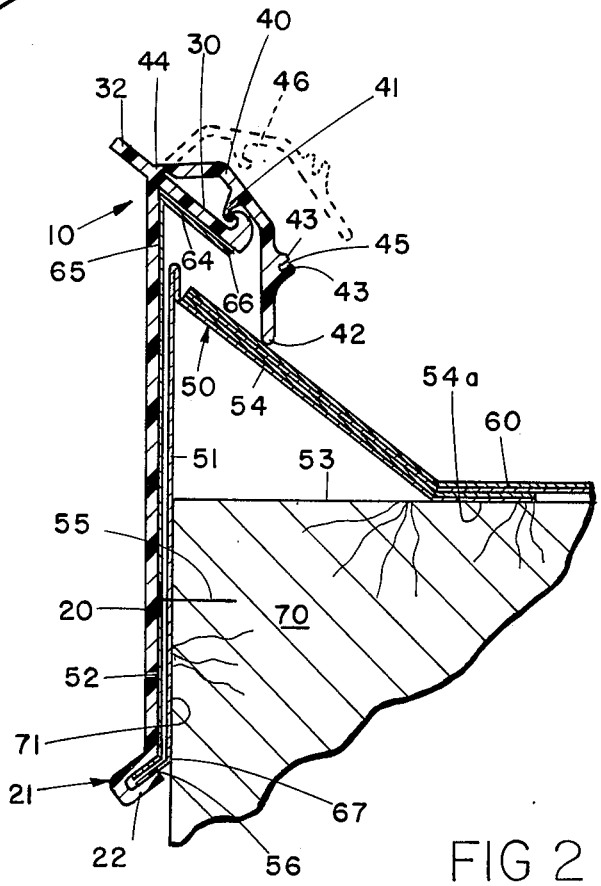
FIG. 2 is a cross section of the structure of FIG. 1 after installation on a roof having a canted periphery strip and with the undeformed position shown in phantom lines.

Legs 30 and 40 protrude inwardly over the roof from the upper extremity of face member 20, are elongated and have one end integrally connected to member 20 along its length. Leg 40 is deformably coupled to member 20 and extends above and beyond leg 30. The junction of leg 40 and face member 20 is reduced in thickness to define a deformable junction or neck 44 to provide for downward rotation of leg 40 about neck 44. The inside opposing (i.e. facing) surfaces of legs 30 and 40 have integral elongated hooks 31 and 41, respectively, extending along the length of legs 30 and 40 and positioned to engage one another for coupling legs 30 and 40 together when leg 40 is rotated toward leg 30. Leg 40 has a securing tip 42 for compressively holding a roofing material 60 against a water dam 50 as shown in FIG. 2. A longitudinally extending, outwardly and upwardly protruding extension 32 integrally extends from the upper portion of front face 20.

Leg 40 further includes generally upwardly protruding, parallel, spaced flanges 43 extending longitudnally along the outer surface of leg 40 defining a longitudinal slot 45 therebetween. Slot 45 is adapted to receive an instrument such as a screwdriver to facilitate the downward deformation of leg 40. As can be seen from FIG. 1, to facilitate installation leg 40 can be segmented into lengths of about two feet with one-eighth inch notches 47 between adjacent segments. Notch 47 extends into leg 40 from securing tip 42 to neck 44 so only a two foot section of leg 40 must be rotated and secured to leg 30 at one time. Thus, when fascia compression clip 10 is being installed, attention can be directed to a relatively small segment of leg 40 and installation more readily accomplished.

Referring to FIG. 2, a canted water dam 50 has a generally planar vertical surface 51 extending along and above the front face 52 of wall 70 of a building. Water dam 50 further includes an integral planar canted surface or sheet 54 connected to surface 51 above roof level and angling downward toward the roof. Sheet 54 is elongated along the periphery of the roof and act to block water flow and support an outwardly extending and upwardly sloping periphery of roofing material 60. Advantageously, at roof 53, sheet 54 has an integral end flange **54*a* extending horizontally along the roof. Canted water dam 50 is typically connected to wall 70 by a nail 55 driven horizontally through planar surface 51 into the wall. The bottom edge of planar surface 51 has a flange 56 extending downwardly and outwardly for acting in cooperation with surface 54 to provide support means to which fascia compression clip 10 can be attached. Flange 56 is received by opening 22 of fascia compression clip 10 thus securing front face 20** against further upward and outward movement.

A concealed cover plate 64 has a planar front surface 65 generally coextensive with planar surface 51 and extending above surface 51. An integral flange 66 extends downwardly and inwardly from the top edge of front surface 65 and has the same angle with respect to front surface 65 as leg 30 does with front face 20. An outwardly extending flange 67 extends along its lower edge. Cover plate 64 is secured by driving a nail through front surface 65 into wall 70. Cover plate 64 is located at the boundary between two adjacent sections of fascia compression clip 10 to provide a visually continuous surface, and accordingly it need not extend beneath the entire length of the fascia compression clip 10.

To install fascia compression clip 10, a length of canted water dam 50 is secured to wall 70 adjacent roof 53 by nails 55 driven through planar surface 51 at longitudinally spaced intervals. Roofing material 60 is extended from roof 53 onto the surface 54 of canted water dam 50. Cover plates 64 are positioned along water dam 50 at longitudinally spaced intervals corresponding to the length of fascia compression clip 10 at the boundaries between sections of fascia. Cover plates 64 are also secured by horizontal nails extending through surface 65 into wall 70. Fascia 10 is initially installed on canted water dam 50 with leg 40 in a non-deformed, raised configuration as shown by phantom lines 46 in FIG. 2. More specifically, the fascia compression clip 10 is positioned so opening 22 receives flange 56 of canted water dam 50 and flange 67 of cover plate 64. Leg 30 is then snapped over cover plate 64.

When face member 20 of fascia compression clip 10 is positioned against surface 51 of canted water dam 50, roof material 60 extends under leg 40 along the longitudinal extent of a section of leg 40. A screwdriver can then be inserted into longitudinal slot 45 and a section of leg 40 is bent down to compress the roofing material between tip 42 and surface 54 the hooks 31 and 41 will then engage locking leg 40 in this position, compressing the roof material 60. Thus, the lengths of hooks 31 and 41 are selected to assure that the roofing material will be securely held in place when leg 40 is locked to leg 30. In addition to compressing and sealing roof material 60, leg 40 secures fascia compression clip 10 to water dam 50 and thus to roof 53. Thus, with hooks 31 and 41 engaged and securing tip 42 pressed against roof material 60, the lower end of the fascia cannot withdraw from flanges 56 and 64. Successive sections of leg 40 are deformed until fascia compression clip 10 is completely and securely installed.

As can be seen from the above described embodiment of the invention, there are no exposed nails which may provide a leakage path for water. Further, the seal formed around the perimeter of roofing material 60 is equally compressed around substantially the entire perimeter thereby providing no focal point for the beginning of the cracks. Also of particular significance is the ease with which such a structure can be manufactured and installed. Compressing a deformable leg against a roofing material is easier and faster than inserting screws at spaced intervals either through the roofing material or through the fascia to provide a compression seal. Indeed, no screws need be used in a typical installation. Advantageously, nails can be used to secure canted water dam 50 to wall 70 and save time during construction. Alternatively, an adhesive material can be used to secure canted water dam 50 to wall 70.

Various modifications to the preferred embodiment will, no doubt, occur to those skilled in the various arts to which this invention pertains. For example, the legs which engage one another and the manner by which one or both of them operate to compress the roofing material may be different than that disclosed above. Additionally, the front face of the fascia compression clip can have a different configuration depending upon the construction of the wall and the desired aesthetic appearance. These and all other variations which basically rely on the teachings through which this disclosure has advanced the art are properly considered within the scope of this invention as defined by the appended claims.

The embodiments of the invention in which an exclusive property or privilege is claimed are defined as follows.

1. A fascia compression clip for providing a water tight seal between a roof covered by roof material and an adjacent wall with a generally vertical outer side including:

a generally planar front face extending downwardly in a generally vertical direction along the outer side of the wall and having an inwardly opening receiving means for attaching said front face to the wall;

a deformable leg extending from said front face across the wall toward the roof, said deformable leg deformable from an initial position to a securing position for engaging the roof thereby securing, in cooperation with said receiving means in said front face, said fascia compression clip to the roof and compressing the roof material;

securing means extending from said front face toward said deformable leg for coupling to and securing said deformable leg in said securing position, said securing means including a support leg extending from said front face so said support leg is positioned between said deformable leg and the roof; said support leg having an engaging means which engages said deformable leg in said securing position and prevents movement of said deformable leg from said securing position, said engaging means including a pair of interacting hooks, one hook extending from said deformable leg and one hook extending from said support leg; and a lever receiving means including a pair of longitudinal, spaced flanges forming a slot therebetween extending along the outside of said deformable leg.

2. Means providing a water tight coupling between a wall with a generally vertical outer side and an adjacent roof covered by roof material, said roof having an edge abutting said wall, comprising:

a clip integrally extruded of aluminum having a generally planar front face, said front face positioned with a generally vertical orientation along the outer side of the wall; and said clip having a first leg and a second leg extending therefrom in spaced relationship; said first and second legs extending away from an upper portion of said front face toward the roof so that said first and second legs extend from the edge of the roof out over the roof; said first leg having a deformable connection between said first leg and said front face for facilitating positioning said first leg in a deformed position wherein said first leg presses against roof material for securing the roof material thereunder;

engaging means cooperating between said first and second legs for locking said legs together when said first leg is in said deformed position; and said clip including an inwardly opening receiving means along the lower portion of said clip for attaching said front face to the wall, said receiving means acting in cooperation with said first leg in said deformed position for securing said clip to the roof and compressing the roof material so that the one operation of placing said first leg in said deformed position cooperates with said inwardly opening receiving means to secure said clip to the wall and roof and said one operation further seals the roofing material without the use of an opening through said clip for nails or the like.

3. Means as recited in claim 1 wherein said first leg includes leverage receiving means for acting in cooperation with a lever to apply a deforming force to said first leg to bring said first leg into engagement with said second leg and to bring said first leg against the roof material.

4. Apparatus providing a water tight seal between a wall and planar seal means on a roof comprising:

a fascia support means having a canted surface providing a water dam at the edge of a roof and having engaging means for coupling to said roof;

an elongated one-piece fascia having receiving means along the lower portion of said fascia for coupling to said support means, a first deformable leg extending over said roof for compressing said planar seal means between said canted surface of said support means and said first leg when said first leg is in a deformed position; a second leg below the first leg and extending from the fascia and including an engaging means for securing said first leg in said deformed position; and said one-piece fascia being secured to said fascia support means by said receiving means acting in cooperation with said first leg when said first leg is in a deformed position thereby securing said one-piece fascia to the roof and compressing said planar seal means, so that the one operation of placing said first leg in said deformed position cooperates with said inwardly opening receiving means to secure said fascia to the wall and roof and said one operation further seals the planar seal means without the use of an opening through said clip for nails or the like.

5. An apparatus as recited in claim 4 wherein said engaging means includes a second leg extending from said fascia and beneath said first leg, a downwardly depending hook from said first leg and an upwardly extending hook from said second leg positioned so said hooks interengage when said first leg and said second leg are moved toward each other.

6. Apparatus providing a water tight seal between a wall and planar seal means on a roof comprising:

a fascia support means having a canted surface providing a water dam at the edge of a roof and having engaging means for coupling to said roof;

an elongated one-piece fascia having receiving means for coupling to said support means, a first deformable leg extending over said roof for compressing said planar seal means between said canted surface of said support means and said first leg when said first leg is in a deformed position; an engaging means for securing said first leg in said deformed position; and said one-piece fascia being secured to said fascia support means by said receiving means acting in cooperation with said first leg when said first leg is in a deformed position thereby securing said one-piece fascia to the roof and compressing said planar seal means;

said engaging means including a second leg extending from said fascia and beneath said first leg, a downwardly depending hook from said first leg and an upwardly extending hook from said second leg positioned so said hooks interengage when said first leg and said second leg are moved toward each other; and said first leg including lever receiving means comprising a pair of longitudinally extending, spaced flanges with an intervening slot for receiving a screwdriver-like instrument.

7. An apparatus as recited in claim 6 wherein said first leg has a narrowed neck portion connecting said first leg to the remainder of said fascia.

8. An apparatus as recited in claim 7 wherein said first leg has transverse notches extending from the outer extremity of said first leg to said narrowed neck, said notches being longitudinally spaced along the length of said fascia thereby providing a plurality of deformable leg segments connected to the continuous fascia strip and permitting individual movement of each first leg segment for compressing a roofing material.

9. An apparatus as recited in claim 8 further comprising a plurality of axially aligned pieces of fascia, a junction between adjacent pieces of fascia; a cover plate mounted between said fascia support means and said fascia at the junction of adjacent pieces of fascia for covering the junction of adjacent pieces of fascia; said cover plate extending generally from between said fascia and said fascia support means to adjacent said second leg.

* * * * *